United States Patent [19]

Kranc et al.

[11] 3,986,795

[45] Oct. 19, 1976

[54] FUEL INJECTION ASSEMBLY

[75] Inventors: Stanley J. Kranc, Morton; Ziedonis I. Krauja, East Peoria; Joseph P. Little, Jr., Morton, all of Ill.

[73] Assignee: Caterpillar Tractor Co., Peoria, Ill.

[22] Filed: June 11, 1975

[21] Appl. No.: 585,927

Related U.S. Application Data

[63] Continuation of Ser. No. 390,540, Aug. 22, 1973, abandoned.

[52] U.S. Cl. ..... 417/296; 417/558

[51] Int. Cl.[2] ..... F04B 49/00

[58] Field of Search ..... 417/296, 558; 123/139 AD

[56] References Cited

UNITED STATES PATENTS

| | | | |
|---|---|---|---|
| 310,459 | 1/1885 | Nicholson et al. | 417/296 |
| 758,183 | 4/1904 | Kryszat | 417/558 |
| 990,616 | 4/1911 | Whitaker | 417/296 |
| 1,688,978 | 10/1928 | McCallum et al. | 417/558 |
| 2,090,781 | 8/1937 | Camner | 417/558 |
| 3,340,860 | 9/1967 | Groschel et al. | 417/296 |

FOREIGN PATENTS OR APPLICATIONS

| | | | |
|---|---|---|---|
| 1,134,166 | 4/1957 | France | 417/558 |
| 399,858 | 10/1933 | United Kingdom | 417/296 |

*Primary Examiner*—William L. Freeh
*Attorney, Agent, or Firm*—Phillips, Moore, Weissenberger, Lempio & Strabala

[57] ABSTRACT

There is disclosed a fuel injector assembly having a disc type delivery valve and a reverse check combined with the delivery valve to control secondary pressure to reduce fuel line erosion due to cavitation. The arrangement provides an unobstructed passageway for fuel delivery upon opening of the valve.

3 Claims, 2 Drawing Figures

FUEL INJECTION ASSEMBLY

This is a continuation of Ser. No. 390,540, filed Aug. 22, 1973, now abandoned.

BACKGROUND OF THE INVENTION

The present invention relates to a fuel injection system and pertains more particularly to a valve arrangement in an injection system to prevent cavitation.

Fuel injection systems must employ a rather sharp fuel cutoff at the injector nozzle to avoid dribbling which in turn causes poor combustion and waste of fuel. When high injection pressures and high engine speeds are used, this sharp cutoff can cause large pressure fluctuations in the lines between the injection pump and the nozzle. This can cause cavitation when pressure in the injection lines drops below the vapor pressure of the fuel.

The known prior art approach to such problem is to dampen the secondary pressure waves developed in the system. This approach utilizes a plurality of restricted passages to dampen the pressure waves while permitting fluid flow. This approach is exemplified by the following U.S. Pat. Nos. 2,888,876 issued June 2, 1959 to Nichols, and 3,364,863 issued Jan. 13, 1968 to Olszewski, et al.

The major drawback to this approach is that it hampers high speed operation of an engine. The restrictions reduce flow rates necessary for such high speed operation.

SUMMARY AND OBJECTS OF THE INVENTION

It is the primary object of the present invention to provide a simple injection valve assembly that overcomes the above problems of the prior art.

Another object of the present invention is to provide a simple and inexpensive valve arrangement that is effective to reduce the problem of cavitation in a fuel injection system.

In accordance with the present invention, there is provided a simple check valve arrangement utilizing a delivery check and a reverse check to reduce pressure fluctuations that cause cavitation in fuel injection systems.

BRIEF DESCRIPTION OF THE DRAWINGS

The above and other objects and advantages of the present invention will become apparent from the following description when, read in conjunction with the accompanying drawings wherein.

DETAILED DESCRIPTION OF PREFERRED EMBODIMENT

Figure 1:
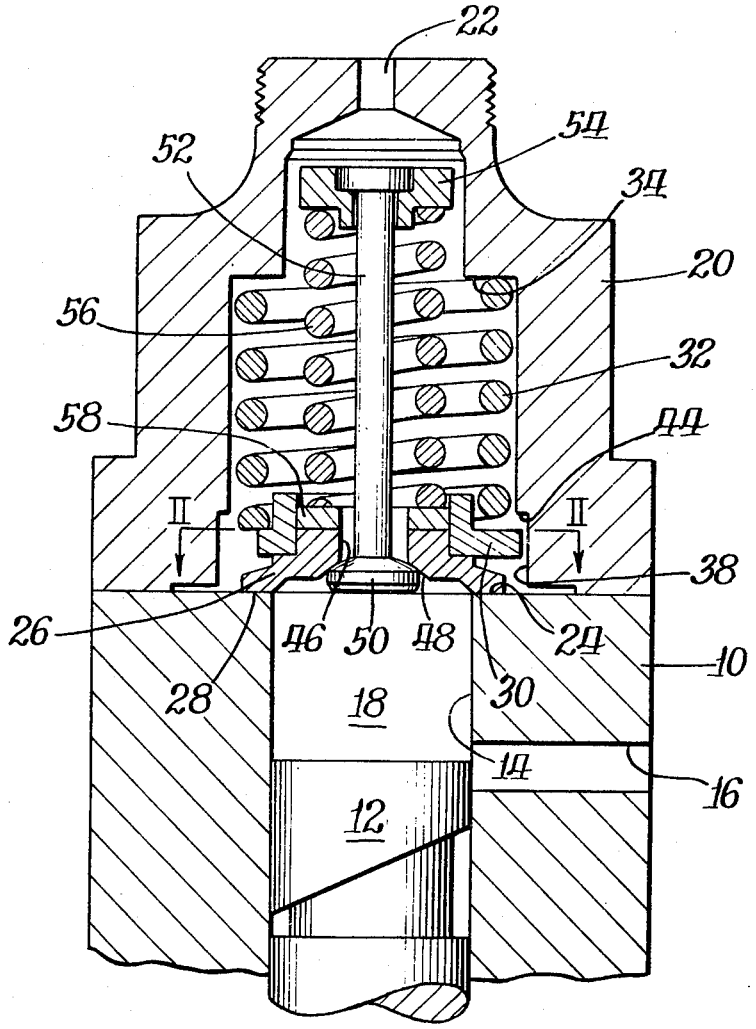
FIG. 1 is an elevational view in section of a preferred embodiment of the present invention.

With reference now to the drawings there is shown, particularly in FIG. 1 the preferred embodiment of the present invention comprising generally a housing 10 having a plunger 12 reciprocally mounted in a bore 14 of the housing. A fuel inlet passage 16 is formed in the housing and communicates between a fuel source not shown and bore 14. A pump pressure chamber 18 is formed in the end of bore 14 between plunger 12 and an adapter 14 which forms delivery valve holder enclosing the end of the housing and including a delivery passage 22 operatively connected in the conventional manner for delivering the pressurized fuel to the injector nozzles.

Figure 2:
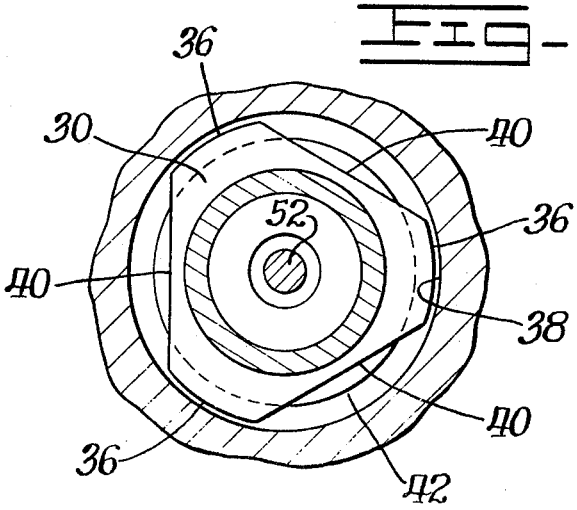
FIG. 2 is a section taken similarly along lines II—II of FIG. 1.

The delivery valve assembly of the injector assembly comprises means defining an annular valve seat 24 surrounding bore 14 and an annular disc-shaped delivery valve 26 having an annular portion 28 engaging valve seat 24. A generally annular guide and stop member 30 rests on top of valve member 26 and is biased therewith by means of a spring member 32 disposed therebetween and engaging a shoulder 34 formed in the adapter housing 20 for biasing the valve into closing engaging with its valve seat. The guide and stop member 30 is a general configuration as best seen in FIG. 2 and includes arcuate guide surfaces 36 to engage the wall of bore 38 for preventing lateral displacement of the valve member. The guide member further includes flat portions 40 to provide a generally unobstructed flow path 42 for the flow of pressurized fluid from chamber 18 to outlet 22. The upper surface of the guide and stop member 30 engages shoulder 44 for the purpose of limiting the upper travel of the valve member 26.

A reverse flow check for relieving secondary pressure comprises a central bore 46 formed in valve member 26 and including means defining an annular valve surface or seat 48 and a disc-like valve element 50 engaging the seat 48. The disc valve element 50 includes an elongated stem 52 extending upwardly therefrom away from the pump chamber 18 and is provided with a keeper 54 which engages the upper end thereof to retain a compression spring 56 disposed between the keeper and valve member 26. A spring-tension adjusting disc 58 may be interdisposed between the spring member and valve member 26 to adjust the compression of the reverse check valve.

This arrangement provides a very simple and inexpensive arrangement for controlling secondary pressures in an injection system and at the same time avoids damping the injection cycle itself. The disc-type valve construction of the present invention provides or permits the simplified construction and at the same time eliminates obstructions and excess damping as provided by the prior art.

In the operation of the present device, as plunger 12 moves upwardly in bore 14 on the injection cycle it compresses pressurized fluid trapped in chamber 18 forcing it upwardly against the face of valve 26 forcing it off of its seat and upwardly against stop member 44. The pressurized fluid flows outwardly against fluid contained in the outlet passage 22, the injector lines, and nozzle and the fluid therein becomes pressurized and as the injection nozzle valve opens, injection into the compression chamber of an engine begins. When the plunger 12 reaches the end of its stroke, injection ceases and the valve 26 closes. Secondary pressures are developed as the result of the abrupt ceasing of the injection cycle. These pressures result from shock waves resulting from high pressure at the nozzle traveling backward toward the pump. These high secondary pressures because of valve 26 preventing backflow can result in cavitation due to a decrease in the pressure line at points because of the rapid reverse or secondary pressure waves. The reverse check valve 50 of the present invention is set at a pressure to permit the relief of this secondary pressure above specified or predetermined pressures which can cause the cavitating condition. Such conditions generally occur at higher operating speeds and because of the existence of check valve 50, the pressure in the injector lines is relieved into pressure pump chamber 18. The valve pressure of valve 50 is set high enough to avoid excess drainage of fluid from the injector lines which would result in an excess delay of injection during the injection cycle. Thus the combination of the reverse check 50 and the simplified valve arrangement of the delivery valve permitting unobstructed flow on the injection cycle combines to permit efficient operation of an injector assembly and at the same time prevent destructive cavitation within the injector lines.

While the present invention has been described with respect to a specific embodiment, it is to be understood that changes in modifications may be made therein without departing from the spirit and scope of the present invention as defined in the appended claims.

What is claimed is:

1. An incompressible fluid injector assembly the combination comprising:

housing means having a first cylindrical bore formed therein and a plunger reciprocally disposed in said first bore for defining a pump chamber therein;

an inlet opening communicating with said pump chamber;

a second bore having stepped diameter coaxially disposed cylindrical portions defining a high pressure chamber coaxial of and communicating with said pump chamber and including a high pressure outlet opening coaxial thereof;

a delivery valve mounted in said high pressure chamber and opening away from said plunger for controlling the flow of pressurized fluid from said pump chamber to said high pressure chamber and high pressure outlet, said delivery valve comprising an annular disc valve including a central bore defining an opening through said disc, and said annular disc including means defining an annular seat surrounding said opening;

first compression spring means mounted within said high pressure chamber for biasing said delivery valve to a closed position;

stop means for limiting the travel of said delivery valve for reducing travel time of said valve and for preventing bottoming of said first compression spring means; and, damping means comprising a reverse check valve including second compression spring means carried by said delivery valve and mounted in said opening in said delivery valve and engaging said annular seat for blocking flow of fluid through said opening toward said high pressure chamber, and responsive for providing unobstructed flow of fluid back to said pump chamber from said high pressure chamber and outlet at a predetermined pressure for reducing secondary pressure in incompressible fluid delivered by said pump for preventing cavitation in said incompressible fluid, wherein said check valve includes an elongated stem connected to the center of a disc element and extending away from said plunger;

said second compression spring means is connected between said stem and said delivery valve for urging said reverse valve to the closed position; and guide means detachably carried by said delivery valve for engaging one diameter of said second bore for guiding said delivery valve axially of said first and second bores within said high pressure chamber and for engaging a shoulder defined by said stepped bore for defining said stop means.

2. The injection assembly of claim 1 including adjusting means for said second compression spring means for adjusting the tension of said second spring means to a range for preventing cavitation and for preventing return of an excess amount of said fluid to said pump chamber.

3. An incompressible fluid injector assembly the combination comprising:

housing means having a first cylindrical bore formed therein and a plunger reciprocally disposed in said first bore for defining a pump chamber therein;

an inlet opening communicating with said pump chamber;

a second bore having stepped diameter coaxially disposed cylindrical portions defining a high pressure chamber coaxial of and communicating with said pump chamber and including a high pressure outlet opening coaxial thereof;

a delivery valve mounted in said high pressure chamber and opening away from said plunger for controlling the flow of pressurized fluid from said pump chamber to said high pressure chamber and high pressure outlet, said delivery valve comprising an annular disc valve including a central bore defining an opening through said disc, and said annular disc including means defining an annular seat surrounding said opening;

first compression spring means mounted within said high pressure chamber for biasing said delivery valve to a closed position;

stop means for limiting the travel of said delivery valve for reducing travel time of said valve and for preventing bottoming of said first compression spring means; and, damping means comprising a reverse check valve including second compression spring means carried by said delivery valve and mounted in said opening in said delivery valve and engaging said annular seat for blocking flow of fluid through said opening toward said high pressure chamber, and responsive for providing unobstructed flow of fluid back to said pump chamber from said high pressure chamber and outlet at a predetermined pressure for reducing secondary pressure in incompressible fluid delivered by said pump for preventing cavitation in said incompressible fluid, wherein said check valve includes an elongated stem connected to the center of a disc element and extending away from said plunger, and said second compression spring means is connected between said stem and said delivery valve for urging said reverse valve to the closed position;

guide means for guiding said delivery valve axially of said first and second bores within said high pressure chamber;

adjusting means for said second compression spring means for adjusting the tension of said second spring means to a range for preventing cavitation and for preventing return of an excess amount of said fluid to said pump chamber, said adjusting means includes disc means for insertion between one end of said second spring means and said delivery valve;

said guide means comprises a general triangular shaped disc mounted on said delivery valve having outer arcuate guide surfaces engaging the walls of said second bore; and, said stop means comprises the outermost portions of said triangular shaped disc engaging an annular shoulder defined between portions of said stepped bore.

* * * * *